United States Patent [19]

Sommers

[11] Patent Number: 4,631,932

[45] Date of Patent: Dec. 30, 1986

[54] KNITTED WAISTBAND CURL-PREVENTING STRIP

[75] Inventor: Louis Sommers, Stroudsburg, Pa.

[73] Assignee: S.R.C. Textiles, Inc., Stroudsburg, Pa.

[21] Appl. No.: 734,297

[22] Filed: May 15, 1985

[51] Int. Cl.[4] ..... D04B 23/08

[52] U.S. Cl. ..... 66/192; 66/193

[58] Field of Search ..... 66/190, 192, 193, 202, 66/177

[56] References Cited

U.S. PATENT DOCUMENTS 3,673,820 4/1972 Sarmiento ..... 66/193

4,248,064 2/1981 Odham ..... 66/192

4,551,994 11/1985 Vailati et al. ..... 66/190

*Primary Examiner*—Ronald Feldbaum

*Attorney, Agent, or Firm*—Michael F. Petock

[57] ABSTRACT

A knitted waistband curl-preventing strip is disclosed in which the monofilament stiffener element is knitted into the strip as a part of the courses, but is not inlaid through the outer most lateral wales so that the monofilament stiffener does not extend from lateral edge to lateral edge of the strip. The waistband curl-preventing strip provides soft of flexible edges, and a larger turning radius for the monofilament stiffener which prevents breakage of the monofilament stiffener.

10 Claims, 3 Drawing Figures

KNITTED WAISTBAND CURL-PREVENTING STRIP

BACKGROUND

The present invention relates to a waistband curl-preventing strip, and more particularly, one that is knitted. More particularly, the present invention relates to a knitted waistband curl-preventing strip wherein the stiff monofilament element is contained within the knitted strip in such a manner as to prevent breakage of the monofilament and provides flexible protective edges.

The present invention is directed to an improved strip for enclosure a in waistband for wearing apparrel such as trousers in order to prevent rolling over or curling of the outer edge portion of the waistband. Various attempts have been made in this area in the past, all with attendant problems and attempts to solve the problems generated. For example, U.S. Pat. No. 3,571,814—Miller is directed to a woven waistband in which a monofilament, e.g. nylon, is woven transversely into a strip. However, the weaving of the relatively rigid monofilament nylon on a narrow loom results in roughness on the edges when the return bights of the weft at the selvages break due to the bending on a small radius of relatively stiff monofilament yarn. Miller attempts to solve that problem by extruding a plastic composition onto the edges to form protective beads.

U.S. Pat. No. 3,155,986—Miller is directed to a waistband construction in which various materials, including perforated plastic strips are utilized as a stiffening element in the waistband of a garment. Miller discloses the use of a strip of perforate resilient material. The strip is perforated to avoid the objectionable effects of perspiration and crepitation, and the element may be rendered perforate by using a woven, netted or knitted fabric or a plastic or other strip punched to provide apertures. However, the strip is uniform in construction, and is preferably made of woven monofilament nylon. Miller does not disclose the waistband structure wherein rigid monofilament is incorporated transversely into a knitted strip.

U.S. Pat. No. 3,129,434—Weemhoff discloses another waistband structure wherein a band or ribbon of thermosetting material, such as nylon or the like, is formed with curves which tend to cause the waistband to assume a shape resulting in a generally concave surface on one side of the band.

All of these structures of prior art have concerns with wearability during the useful life of the garment, and particularly as the garment is dry cleaned, laundered and pressed. Often, where a monofilament element is utlized transversely, the element breaks or for other reasons, causes a poking of the relatively stiff monofilament elements through the waistband structure causing discomfort to the wearer of the garment.

SUMMARY OF THE INVENTION

The present invention relates to a waistband curl-preventing strip. The waistband curl-preventing strip is comprised of a knitted strip of a predetermined width with the knitted strip being knitted from a polyester or other like flexible yarn. Substantially transverse, comparatively stiff monofilaments are positioned substantially transverse to the length of the strip and are positioned within the knitted strip so that it does not extend from lateral edge to lateral edge, but such that there is provided a portion of knittted material laterally to the monofilament stiffener. The monofilament stiffener is positioned within the knitted strip in such a manner that a comparatively large radius of curvature is provided at the lateral exent of each transverse or monofilament stiffener so that monofilament breakage is reduced to a minimum. Two or more sets of weft yarns are inlaid through each course. The weft yarns of one set are inlaid through at least three wale loops, except at the lateral edge of the strip. The weft yarns of the second set are inlaid through at least four wale loops, except at the lateral ends of the strip.

BRIEF DESCRIPTION OF THE DRAWINGS

For the purpose of illustrating the invention, there are shown in the dawings forms which are presently preferred; it being understood, however, that this invention is not limited to the precise arrangements and instrumentalities shown.

DETAILED DESCRIPTION OF THE PREFERRED EMBODIMENTS

The present invention will be described in connection with a stiffening means incorporated within a "waistband". However, it is understood that this description is utilized for the purpose of convenience, and that the present invention is not limited to waistbands. For example, an undergarment, such as a girdle or brassiere, terminates in an edge portion hugging a body region roughly corresponding to the waist. Furthermore, it will be understood that the word "waist" is incapable of exact definition in terms of the human torso. Accordingly, the words "waist" and "waistband" and words of similar import, are utilized herein for the purposes of description, and the same are to be regarded as including those parts of any garment having a free edge portion which is subject to transverse curling or rolling by virtue of the longitudinal tension of the fabric acting alone or co-acting with the flesh of the wearer.

Nor is the invention to be understood as limited by the nature of the waistband exclusive of the stiffening element. Those familiar with this art are aware that waistband material sold as yard goods, as well as those privately manufactured for internal use, usually consist of layers of fabric folded and sewn together in various arrangements. Thus, the stiffening element of the invention may be interposed between two layers of the waistband, or exposed as an inner or outer layer.

Broadly, the present invention comprehends the incorporation within an edge portion of an article of wearing apparel, i.e. a conventional waistband, of a stiffening or waistband curl-preventing strip secured thereto, as by sewing and extending along the waistband, either over the entire extent thereof or over only approximately that portion over which the usual function is principally realized, i.e. the front half of a pair of trousers. This strip comprises some resilient, generally shape-retaining material. In a preferred form, in regard to the invention construction referred to in a pair of trousers, an upper longitudinal region of the garment is provided with a strip having a permanent set so that, by reason of the resiliency of the monofilament stiffener, the tendency of the top margin of the trousers to curl or roll outwardly of the wearer is effectively prevented. To this end the roll preventer strip is positioned within an inwardly folded edge portion of the shell of the garment, i.e. the waist of a pair of trousers.

The resiliency available as a result of adding the strip to the garment prevents rolling and enables the garment to regain its initial shape when roll pressure is removed.

Figure 1:
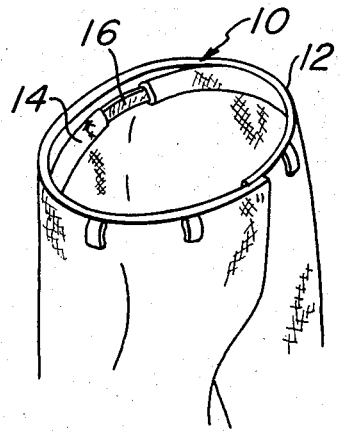
FIG. 1 is a view in perspective of a curl-preventing strip in accordance with the present invention installed in a waistband of a pair of trousers.

Referring now to the drawings, wherein like numerals indicate like elements, there is shown in FIG. 1 a garment 10, such as a pair of trousers, having a waistband 12 which includes a waistband structure 14 having a stiffener element 16 made in accordance with the present invention.

Figure 2:
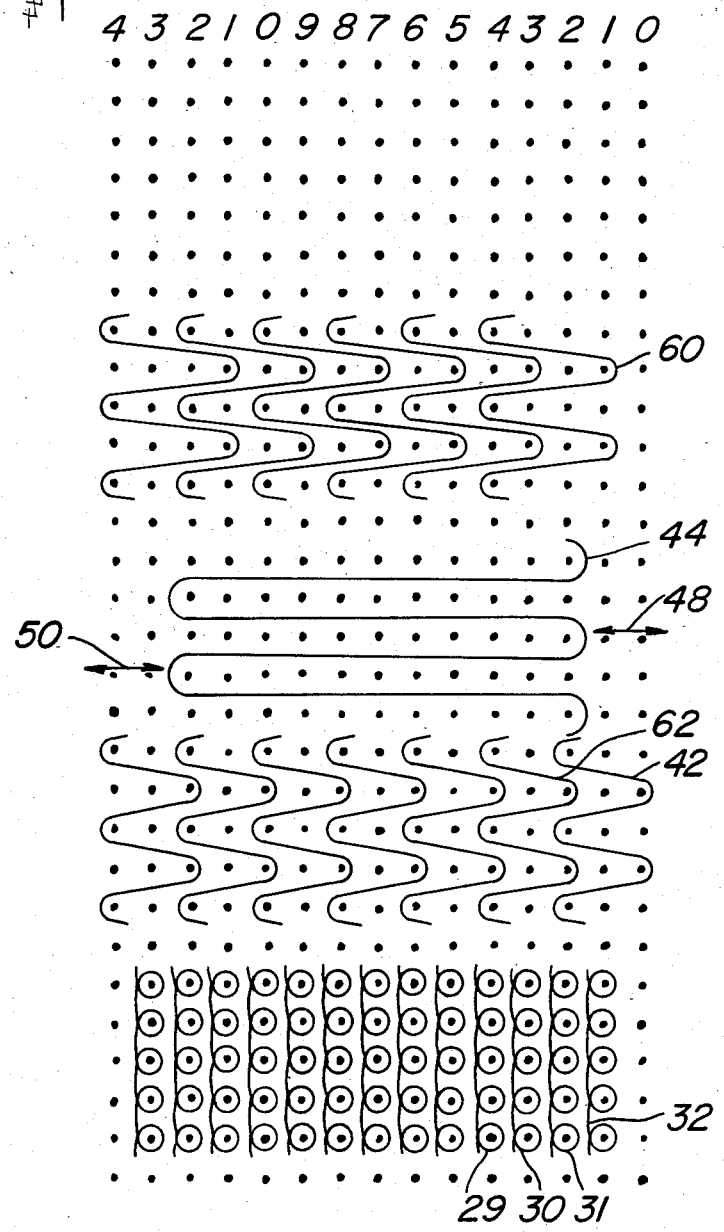
FIG. 2 is a point diagram of the waistband curl-preventing strip in accordance with the present invention.
Figure 3:
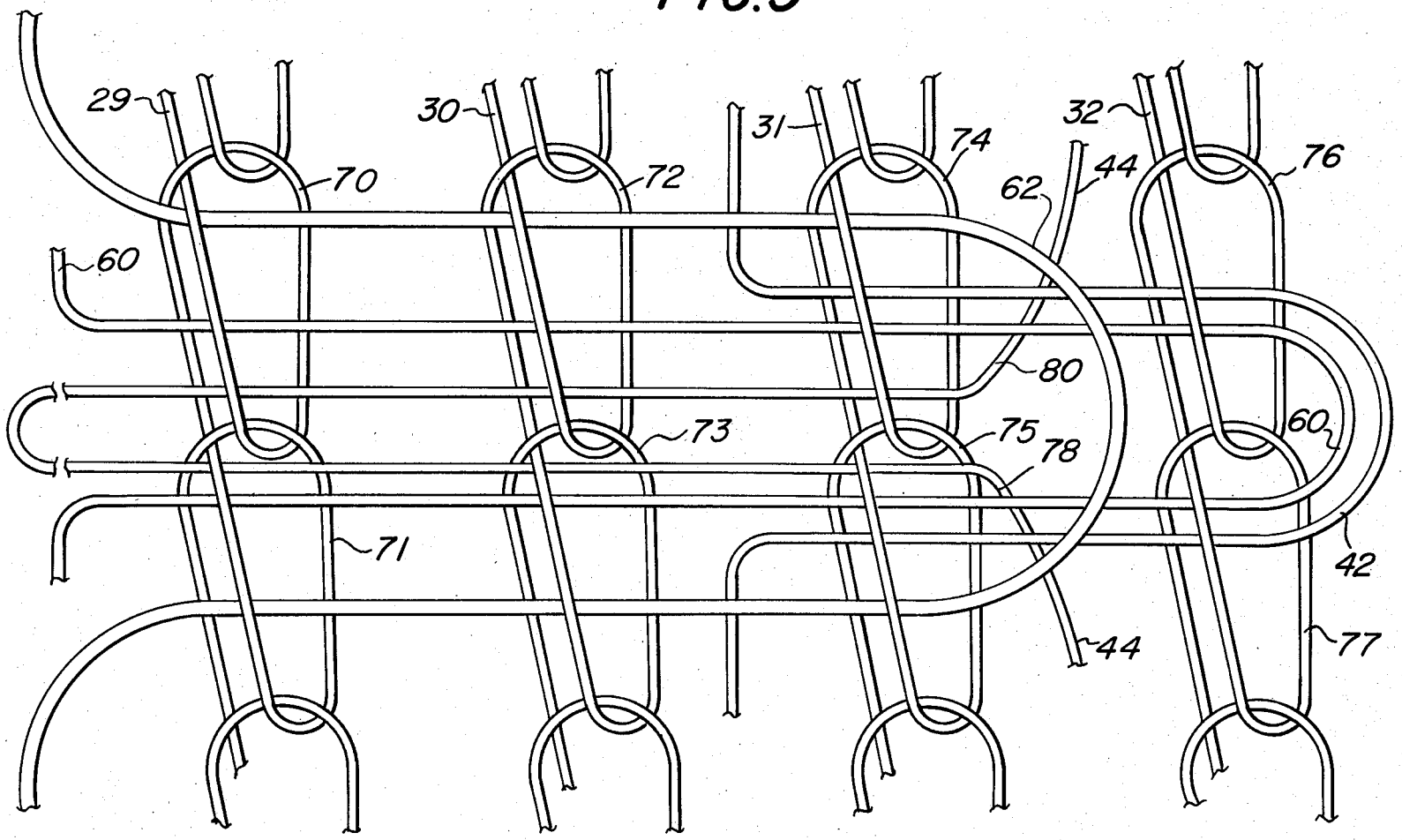
FIG. 3 is an enlarged elevation view of a portion of the knitted structure of the waistband curl-preventing strip depicted in the point of diagram of FIG. 2 of the first four wales.

The stiffener element of the present invention will be described more particularly with respect of FIGS. 2 and 3. FIG. 2 is a point diagram of the waistband curl-preventing strip shown in FIG. 1. FIG. 3 is an exploded or enlarged view of the area of the first four wales in FIG. 2. Such point diagrams are familiar to those skilled in the art.

Referring to FIG. 2, there are thirteen wales, the first four being identified as 32, 31, 30 and 29, which are also shown in FIG. 3. The wales and wefts, except for the monofilament stiffener, are preferably made of polyester material, although other suitable flexible natural and synthetic yarns may be utilized.

Referring to FIG. 1, the knitted strip 16, which may be made by a crochet knitting process, is knitted as shown in FIG. 2. Each weft may vary as to the number of wales inlaid. The wefts are inlaid through three wales, except at the edges of strip 16, where they are inlaid through two wales.

As shown in FIGS. 2 and 3, a monofilament stiffener element 44 is knitted into the fabric such that it does not extend from end to end, but turns back when there is at least one wale left. The monofilament stiffener 44 may be made of nylon or other suitable relatively stiff yarn. In a preferred example, 0.013 inch nylon monofilament has been utilized, but it is understood that other diameters of monofilament nylon or other synthetic fibers may be utilized.

Referring to FIG. 2, with monofilament 44 turning immediately upon being inlaid in wale 31, a relatively flexible portion of knitted material is provided on the lateral edge of strip 16, the distance of which is indicated by the double headed arrows 48 and 50. These lateral portions of knitted material, lateral to the extent of coursing of the monofilament stiffener 44, provide soft and flexible lateral edges to the waistband curl-preventing strip 16. The manner in which the monofilament stiffener 44 is knitted into strip 16 provides relatively large radii of curvature on the monofilament at turns. This relatively large radius of curvature helps prevent breakage of the monofilament, which may occur where the radius of curvature is small. The breakage at small radii of curvature where a woven strip is utilized has been recognized in the prior art, for example, see U.S. Pat. No. 3,571,814.

Referring now to FIG. 3, there is shown an expanded view of the wale loops in wales 29–32, wefts 42 and 60 and monofilament stiffener weft 44. As may be seen, the wale 29 has loops 70 and 71. Wale 30 has loops 72 and 73, wale 31 has loops 74 and 75, and wale 32 has loops 76 and 77. The courses of the relatively soft yarn ends, such as polyester yarn, and the stiff monofilament 44 are inlaid through the loops of various wales. As may be seen, the monofilament 44 does not extend to wale 32, but courses about wale 31 as shown at 78 and 80. This then provides a lateral edge comprised of the wale yarn 32 and, as seen in FIG. 3, the flexible weft ends 42 and 60. As may be seen from FIG. 3, weft ends 42 and 62 are a part of the group or set of wefts are normally inlaid through three wales, except at the lateral ends where they inlaid through two wales. Therefore, weft end 42 is inlaid through two wales, namely, wales 31 and 32. Weft end 62 is inlaid through three wales, namely, 31, 30 and 29. Additionally, in the same course, weft end 60, which is one of a second set of weft yarns, is inlaid through all four wales 29 through 32. The structure as shown in FIG. 3 is repeated throughout, as shown by the point diagram in FIG. 2. The expanded view of the knitted structure in FIG. 3 represents the first 4 wales of the point diagram of FIG. 2.

Upon completion of the knitting process, the curl-preventing strip of the present invention is preferably heat treated to provide it with a heat set to enhance its rigidity and resiliency. In one example, this may be done at a temperature of approximately 275 degrees for about one to three minutes. However, it is apparent that other temperatures and other dwell times may be utilized, and may be desirable where different synthetic materials may be used as the monofilament stiffener, and where other synthetic materials may be utilized for the flexible knitted yarns. This will be apparent to those skilled in the art. In addition, sizing or finish may be applied to the finished product to provide an additional degree of resiliency for this product.

However, it is understood that numerous variations may be made within the concept of the present invention. For example, the monofilament stiffener could be knitted so as to provide larger lateral edges, by not being inlaid through two or more wales along each edge, as contrasted to the single wale that was not inlaid as shown in the preferred embodiment described herein. Furthermore, although the wefts are preferably made of single strand 150 denier polyester, it is understood that other yarn may be utilized including yarn made of other natural or synthetic materials, with differing degrees of strands and with different denier weights. Furthermore, as described above, other stiffeners may be utilized including those made of other materials and of other filament diameters. Other variations will be apparent to those skilled in the art.

In view of the above, the present invention may be embodied in other specific forms without departing from the spirit or essential attributes thereof, and, accordingly, reference should be made to the appended claims, rather than to the foregoing specification as indicating the scope of the invention.

I claim:

1. A waistband curl-preventing strip, comprising:

a knitted strip of a predetermined width, said knitted strip being knitted from polyester or other like flexible yarn utilizing a predetermined number of closed chain stitch wales;

a transverse comparatively stiff monofilament inlaid through wale loops substantially transverse to the length of the strip and being positioned within the knitted strip so that it does not extend from lateral edge to lateral edge of the strip, but such that there is at least one wale on each side laterally to the monofilament stiffener; and at least two sets of weft yarns, one set of weft yarns having weft yarns inlaid through at least three wale loops, except at the lateral edges, and then changing direction, the second set of weft yarns having weft yarns inlaid through at least four wale loops, except at the lateral edges, and then changing direction whereby the wales forming the closed chain stitch and the monofilament stiffener are retained.

2. A waistband curl-preventing strip in accordance with claim 1 wherein said monofilament stiffener is comprised of a monofilament made of nylon.

3. A waistband curl-preventing strip in accordance with claim 1 wherein said knitted material is comprised of polyester.

4. A waistband curl-preventing strip in accordance with claim 1 wherein said knitted waistband is a crochet knit.

5. A waistband curl-preventing strip in accordance with claim 1 wherein said knitted waistband curl-preventing strip is incorporated between layers of material in a trouser garment.

6. A waistband curl-preventing strip, comprising:

a knitted strip of a predeterined width, said knitted strip being knitted from polyester or other like flexible yarn utilizing a predetermined number of closed chain stitch wales;

a transverse comparatively stiff monofilament inlaid through wale loops substantially transverse to the length of the strip and being positioned within the knitted strip so that it does not extend from lateral edge to lateral edge of the strip, but such that there is at least one wale on each side laterally to the monofilament stiffener;

said monofilament stiffener being inlaid through less than all of the wale loops and changing direction with a radius of curvature which is large in comparison to the radius of curvature of such a monofilament stiffener in a woven strip thereby reducing the incidence of monofilament stiffener breakage; and at least two sets of weft yarns, one set of weft yarns having weft yarns inlaid through at least three wale loops, except at the lateral edges, and then changing direction, the second set of weft yarns having weft yarns inlaid through at least four wale loops, except at the lateral edges, and then changing direction whereby the wales forming the closed chain stitch and the monofilament stiffener are retained.

7. A waistband curl-preventing strip in accordance with claim 6 wherein said monofilament stiffener is comprised of a monofilament made of nylon.

8. A waistband curl-preventing strip in accordance with claim 6 wherein said knitted material is comprised of polyester.

9. A waistband curl-preventing strip in accordance with claim 6 wherein said knitted waistband is a crochet knit.

10. A waistband curl-preventing strip in accordance with claim 6 wherein said knitted waistband curl-preventing strip is incorporated between layers of material in a trouser garment.

* * * * *